US012018670B2

(12) United States Patent
Imai

(10) Patent No.: US 12,018,670 B2
(45) Date of Patent: Jun. 25, 2024

(54) TUBE PUMP SYSTEM

(71) Applicant: Surpass Industry Co., Ltd., Saitama (JP)

(72) Inventor: Hiroshi Imai, Saitama (JP)

(73) Assignee: SURPASS INDUSTRY CO., LTD., Saitama (JP)

( * ) Notice: Subject to any disclaimer, the term of this patent is extended or adjusted under 35 U.S.C. 154(b) by 0 days.

(21) Appl. No.: 17/325,702

(22) Filed: May 20, 2021

(65) Prior Publication Data

US 2021/0372392 A1 Dec. 2, 2021

(30) Foreign Application Priority Data

May 26, 2020 (JP) ..... 2020-091401

(51) Int. Cl.
*F04B 43/12* (2006.01)
*F04B 43/00* (2006.01)

(52) U.S. Cl.
CPC ..... *F04B 43/1253* (2013.01); *F04B 43/009* (2013.01)

(58) Field of Classification Search
CPC ..... F04B 43/0009; F04B 43/009; F04B 43/1253; F04B 39/14; F04B 53/22; F04B 43/1292; A61M 5/14232
USPC ..... 417/477.2
See application file for complete search history.

(56) References Cited

U.S. PATENT DOCUMENTS 3,649,138 A 3/1972 Clay et al.
3,726,613 A 4/1973 Von Casimir
3,756,752 A 9/1973 Stenner
3,826,593 A 7/1974 Von Casimir
3,938,909 A 2/1976 Willock
3,985,019 A 10/1976 Boehme et al.
4,142,545 A 3/1979 Lepp et al.
(Continued)

FOREIGN PATENT DOCUMENTS

DE 20109803 10/2002
EP 1942964 A2 7/2008
(Continued)

OTHER PUBLICATIONS

European Search Report received in EP Application No. 21174877.7 entitled, "Tube Pump System," dated Sep. 24, 2021.
(Continued)

*Primary Examiner* — Philip E Stimpert
(74) *Attorney, Agent, or Firm* — Hamilton, Brook, Smith & Reynolds, P.C.

(57) ABSTRACT

Provided is a tube pump system in which a first insertion groove extending along a first axial direction is formed in a first accommodating portion of a first tube pump, the first tube pump includes a first tube holding member that holds a first tube in the first insertion groove, a second insertion groove extending along a second axial direction is formed in a second accommodating portion of a second tube pump, the second tube pump includes a second tube holding member that holds the second tube in the second insertion groove, the shape of the first insertion groove is different from the shape of the second insertion groove, the first tube holding member has a shape corresponding to the first insertion groove, and the second tube holding member has a shape corresponding to the second insertion groove.

5 Claims, 11 Drawing Sheets

(56) References Cited

U.S. PATENT DOCUMENTS

| | | | | |
|---|---|---|---|---|
| 4,142,845 | A | 3/1979 | Lepp et al. | |
| 4,496,295 | A | 1/1985 | King | |
| 4,705,464 | A | 11/1987 | Arimond | |
| 5,388,972 | A * | 2/1995 | Calhoun | F04B 43/1253 417/477.11 |
| 5,533,877 | A * | 7/1996 | Friedmann | F04B 43/1253 417/477.1 |
| 5,586,872 | A | 12/1996 | Skobelev et al. | |
| 5,640,181 | A | 6/1997 | Uchida et al. | |
| 5,657,000 | A | 8/1997 | Ellingboe | |
| 5,971,726 | A | 10/1999 | Yoshida et al. | |
| 6,264,034 | B1 | 7/2001 | Yamazaki | |
| 6,264,634 | B1 | 7/2001 | Yamazaki | |
| 7,645,127 | B2 | 1/2010 | Hagen et al. | |
| 8,047,819 | B2 * | 11/2011 | Lawrence | F16L 3/1033 417/477.2 |
| 10,082,136 | B2 | 9/2018 | Imai et al. | |
| 10,465,673 | B2 | 11/2019 | Ackermann et al. | |
| 10,528,064 | B2 | 1/2020 | Imai et al. | |
| 10,746,168 | B2 | 8/2020 | Imai et al. | |
| 11,542,937 | B2 | 1/2023 | Imai | |
| 2004/0057856 | A1 | 3/2004 | Saxer et al. | |
| 2004/0217236 | A1 | 11/2004 | Shibuya | |
| 2005/0019185 | A1 | 1/2005 | Otis, Jr. | |
| 2006/0245964 | A1 | 11/2006 | Koslov | |
| 2008/0213113 | A1 | 9/2008 | Lawrence et al. | |
| 2009/0053084 | A1 | 2/2009 | Klein | |
| 2011/0033318 | A1 | 2/2011 | Ramirez, Jr. et al. | |
| 2012/0195777 | A1 | 8/2012 | Stejskal et al. | |
| 2013/0072871 | A1 | 3/2013 | Ozturk | |
| 2013/0280104 | A1 | 10/2013 | Heide et al. | |
| 2013/0315763 | A1 | 11/2013 | Neoh et al. | |
| 2015/0159642 | A1 | 6/2015 | Sasa et al. | |
| 2015/0240802 | A1 | 8/2015 | Guthrie et al. | |
| 2015/0330385 | A1 | 11/2015 | Lofstrom et al. | |
| 2016/0245271 | A1 | 8/2016 | Schaefer et al. | |
| 2016/0265519 | A1 | 9/2016 | Igarashi | |
| 2017/0028117 | A1 | 2/2017 | Mochizuki | |
| 2017/0051735 | A1 | 2/2017 | Gaskill-Fox et al. | |
| 2017/0096995 | A1 | 4/2017 | Imai et al. | |
| 2018/0066646 | A1 | 3/2018 | Himmelmann | |
| 2018/0074525 | A1 | 3/2018 | Imai et al. | |
| 2018/0100605 | A1 | 4/2018 | Robinault et al. | |
| 2018/0128266 | A1 | 5/2018 | Gaskill-Fox et al. | |
| 2018/0230987 | A1 | 8/2018 | Imai et al. | |
| 2019/0017500 | A1 | 1/2019 | Minatodani | |
| 2019/0120408 | A1 | 4/2019 | Milner | |
| 2019/0136853 | A1 | 5/2019 | Bach | |
| 2019/0234394 | A1 | 8/2019 | Gledhill, III et al. | |
| 2019/0285064 | A1 | 9/2019 | Imai et al. | |
| 2020/0038581 | A1 | 2/2020 | Bowman et al. | |
| 2020/0208624 | A1 | 7/2020 | Wang et al. | |
| 2020/0263682 | A1 | 8/2020 | Imai | |
| 2021/0239108 | A1 | 8/2021 | Imai | |
| 2021/0372393 | A1 | 12/2021 | Imai | |

FOREIGN PATENT DOCUMENTS

| | | | |
|---|---|---|---|
| EP | 2397695 | A1 | 12/2011 |
| EP | 3543532 | A1 | 9/2019 |
| JP | S52112805 | A | 9/1977 |
| JP | S56129790 | A | 10/1981 |
| JP | 57-026690 | U | 2/1982 |
| JP | S5773882 | A | 5/1982 |
| JP | 62-126585 | U | 8/1987 |
| JP | 04-080545 | U | 7/1992 |
| JP | 04-100086 | U | 8/1992 |
| JP | H05-263765 | A | 10/1993 |
| JP | 2000-205201 | A | 7/2000 |
| JP | 2003-021050 | A | 1/2003 |
| JP | 2008-002388 | A | 1/2008 |
| JP | 2008308994 | A | 12/2008 |
| JP | 2013-240135 | A | 11/2013 |
| JP | 2013231413 | A | 11/2013 |
| JP | 2014214614 | A | 11/2014 |
| JP | 2016169620 | A | 9/2016 |
| JP | 2017062247 | A | 3/2017 |
| JP | 2017067054 | A | 4/2017 |
| JP | 2018044488 | A | 3/2018 |
| JP | 2018131946 | A | 8/2018 |
| WO | 2007/038364 | A2 | 4/2007 |

OTHER PUBLICATIONS

European Search Report received in EP Application No. 21175039.3 entitled, "Tube Holding Member and Tube Pump," dated Nov. 25, 2021.

European Extended Search Report dated Nov. 27, 2017 for European Application No. 17190606.8-1616, entitled "Tube Pump System and Method for Controlling the Tube Pump System.".

European Search Report for European Application No. 19162820.5, entitled Tube Pump System and Method for Controlling the Tube Pump System, dated Jul. 15, 2019.

Extended European Search Report for Application No. 21055305.4, entitled: Tube Pump System and Method for Controlling the Tube Pump System, dated May 8, 2020.

U.S. Non-Final Office Action for U.S. Appl. No. 16/295,319, entitled Tube Pump System and Method for Controlling the Tube Pump System, dated Sep. 11, 2020.

Extended European Search Report for Application No. 21151557.2, entitled: "Tube Pump," dated Mar. 29, 2021.

* cited by examiner

TUBE PUMP SYSTEM

RELATED APPLICATION

This application claims priority under 35 U.S.C. § 119 or 365 to Japanese Application No. 2020-091401, filed on May 26, 2020. The entire teachings of the above application(s) are incorporated herein by reference.

BACKGROUND

1. Technical Field

The present disclosure relates to a tube pump system.

2. Description of Related Art

In the related art, a tube pump that pressure-transfers a liquid in a tube by intermittently squashing a tube with flexibility with a plurality of rollers is known (see Japanese Unexamined Patent Application, Publication No. 2018-131946, for example). The tube pump disclosed in Japanese Unexamined Patent Application, Publication No. 2018-131946 is adapted to cause a liquid in a tube to be ejected on a flow-out side by causing a roller portion to rotate about an axial line in a state in which a flexible tube is squashed.

In Japanese Unexamined Patent Application, Publication No. 2018-131946, a pair of tube pushing rings are attached to the tube in order to hold the position of the tube even in a case in which an external force caused by contact with the roller portion works.

In Japanese Unexamined Patent Application, Publication No. 2018-131946, the position of the tube is fixed relative to a tube case by accommodating the pair of tube pushing rings in a pair of fixing holes formed in the tube case.

In a case in which a tube pump system including a plurality of tube pumps to transport a plurality of types of liquids is used, it is desirable that each tube pump have a roller operation (angular speed and the like) adjusted in advance in accordance with the shape of a tube to be attached to the tube pump, the type of a liquid to be transported through the tube, and the like. Moreover, it is necessary to attach, to each tube pump, an appropriate tube in accordance with the tube pump in order to appropriately transport a liquid with each tube pump.

However, if the shapes of the tube pushing rings with which the tubes are attached to the tube case and the shapes of the fixing holes in which the tube pushing rings are accommodated are common to a plurality of tube pumps, there is a probability that a tube which is not suitable for a specific tube pump is erroneously attached to the specific tube pump.

The present disclosure was made in view of such circumstances, and an object thereof is to prevent a tube that is not suitable for a specific tube pump from being erroneously attached to the specific tube pump in a tube pump system including a plurality of tube pumps.

SUMMARY

The present disclosure employs the following means to solve the aforementioned problem.

A tube pump system according to an aspect of the present disclosure is a tube pump system including: a first tube pump; and a second tube pump, in which the first tube pump includes a first accommodating portion that has a first inner circumferential surface on which a first tube with flexibility is disposed in an arc shape around a first rotational axis, a first roller portion that is accommodated in the first accommodating portion and rotates about the first rotational axis in a state in which the first tube is blocked, a first insertion groove extending along a first axial direction being formed in the first accommodating portion, and a first tube holding member that holds the first tube in the first insertion groove along the first axial direction, the second tube pump includes a second accommodating portion that has a second inner circumferential surface on which a second tube with flexibility is disposed in an arc shape around a second rotational axis, a second roller portion that is accommodated in the second accommodating portion and rotates about the second rotational axis in a state in which the second tube is blocked, a second insertion groove extending along a second axial direction being formed in the second accommodating portion, and a second tube holding member that holds the second tube in the second insertion groove along the second axial direction, a shape of the first insertion groove is different from a shape of the second insertion groove, the first tube holding member has a shape corresponding to the first insertion groove, and the second tube holding member has a shape corresponding to the second insertion groove.

According to the tube pump system in the aspect of the present disclosure, the first insertion groove extending along the first axial direction is formed in the first accommodating portion of the first tube pump, and the second insertion groove extending along the second axial direction is formed in the second accommodating portion of the second tube pump. The first tube is held in the first insertion groove along the first axial direction by the first tube holding member, and the second tube is held in the second insertion groove along the second axial direction by the second tube holding member.

According to the tube pump system in the aspect of the present disclosure, the shape of the first insertion groove is different from the shape of the second insertion groove. Also, the first tube holding member has the shape corresponding to the first insertion groove, and the second tube holding member has the shape corresponding to the second insertion groove. Therefore, the first tube holding member that holds the first tube is prevented from being attached to the second insertion groove that does not correspond to the shape of the first insertion groove.

Similarly, the second tube holding member that holds the second tube is prevented from being attached to the first insertion groove that does not correspond to the shape of the second insertion groove. It is thus possible to prevent a tube that is not suitable for a specific tube pump from being erroneously attached to the specific tube pump in a tube pump system including a plurality of tube pumps.

The tube pump system according to the aspect of the present disclosure is preferably configured such that the first tube holding member includes a pair of first wall portions disposed at an interval in a first width direction that perpendicularly intersects the first axial direction to hold the first tube in a pinched state, the second tube holding member includes a pair of second wall portions disposed at an interval in a second width direction that perpendicularly intersects the second axial direction to hold the second tube in a pinched state, and a first interval between the pair of first wall portions in the first width direction and a second interval between the pair of second wall portions in the second width direction are different from each other.

According to the tube pump system with this configuration, the first interval between the pair of first wall portions of the first tube holding member in the first width direction and the second interval between the pair of second wall portions of the second tube holding member in the second width direction are different from each other. Therefore, even if the second tube is inserted between the pair of first wall portions of the first tube holding member, the second tube is not appropriately held therebetween. Similarly, even if the first tube is inserted between the pair of second wall portions of the second tube holding member, the first tube is not appropriately held therebetween. It is thus possible to prevent the second tube from being erroneously held by the first tube holding member and to prevent the first tube from being erroneously held by the second tube holding member.

The tube pump system according to the aspect of the present disclosure is preferably configured such that a groove width of the first insertion groove and a groove width of the second insertion groove are different from each other.

According to the tube pump system with this configuration, the groove width of the first insertion groove and the groove width of the second insertion groove are different from each other, and the first tube holding member is thus prevented from being attached to the second insertion groove. Similarly, the second tube holding member is prevented from being attached to the first insertion groove.

The tube pump system according to the aspect of the present disclosure is preferably configured such that the first insertion groove has a same shape at each location in the first axial direction, and the second insertion groove has different shapes at each location in the second axial direction.

According to the tube pump system with this configuration, the first insertion groove has the same shape at each location in the first axial direction while the second insertion groove has the different shapes at each location in the second axial direction. Therefore, the first tube holding member is prevented from being attached to the second insertion groove, and the second tube holding member is prevented from being attached to the first insertion groove.

The tube pump system according to the aspect of the present disclosure is preferably configured such that the first tube holding member is provided with a first display portion that displays first identification information for identifying the first tube, and the second tube holding member is provided with a second display portion that displays second identification information for identifying the second tube.

According to the tube pump system with this configuration, it is possible for an operator to appropriately identify the first tube to be attached to the first tube holding member by recognizing the first identification information displayed at the first display portion of the first tube holding member. Similarly, it is possible for the operator to appropriately identify the second tube to be attached to the second tube holding member by recognizing the second identification information displayed at the second display portion of the second tube holding member.

The tube pump system according to the aspect of the present disclosure is preferably configured such that a first angular speed when the first roller portion rotates about the first rotational axis and a second angular speed when the second roller portion rotates about the second rotational axis are different from each other.

According to the tube pump system with this configuration, a situation in which the second tube is erroneously attached to the first tube pump, the first roller portion rotates relative to the second tube at the first angular speed, and pulsation of a liquid ejected from the second tube increases is prevented. Similarly, a situation in which the first tube is erroneously attached to the second tube pump, the second roller portion rotates relative to the first tube at the second angular speed, and pulsation of a liquid ejected from the first tube increases is prevented.

According to the present disclosure, it is possible to prevent a tube that is not suitable for a specific tube pump from being erroneously attached to the specific tube pump in a tube pump system including a plurality of tube pumps.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

A description of example embodiments follows.

The teachings of all patents, published applications and references cited herein are incorporated by reference in their entirety.

Figure 1:
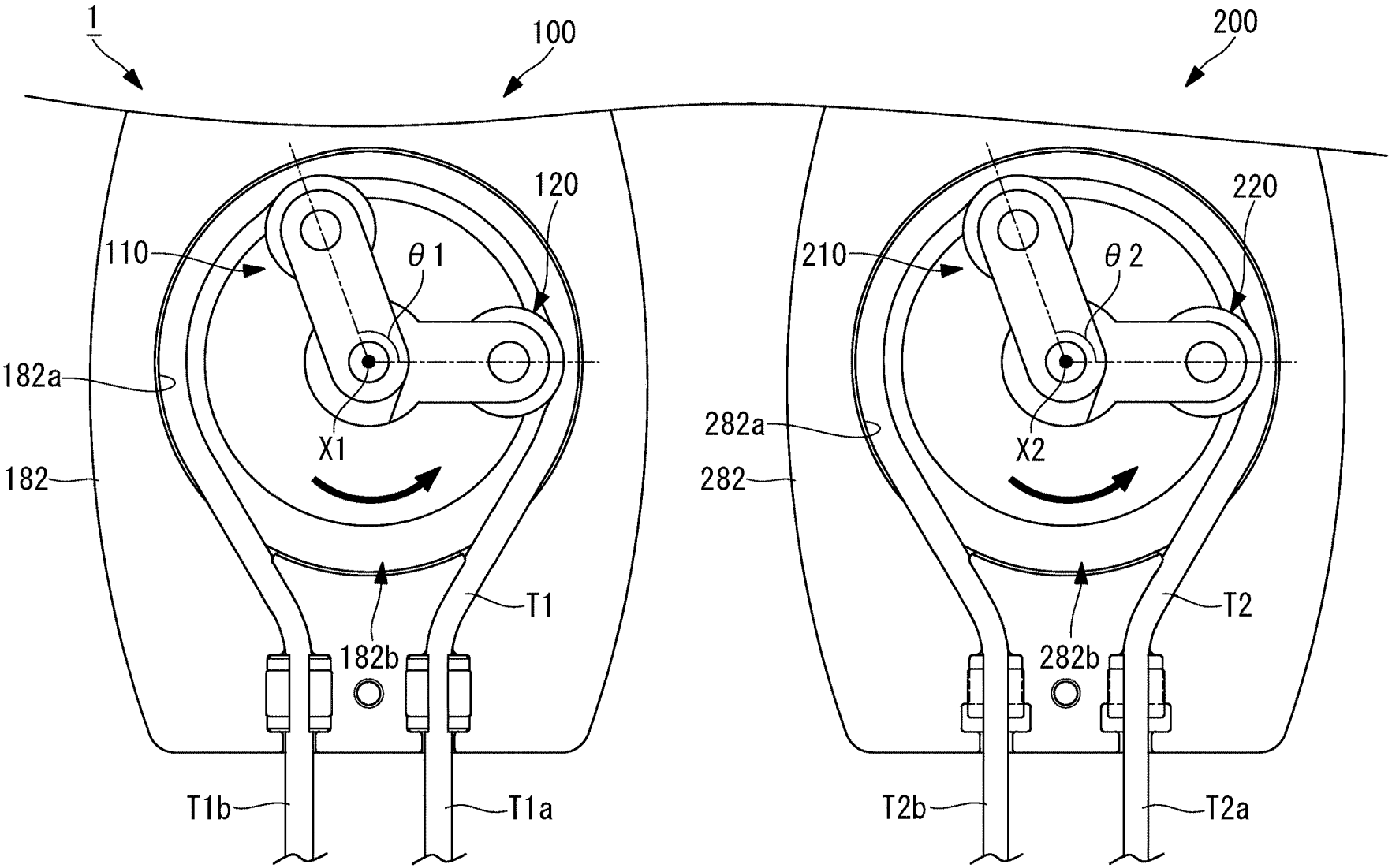
FIG. 1 is a plan view illustrating an embodiment of a tube pump system.
Figure 2:
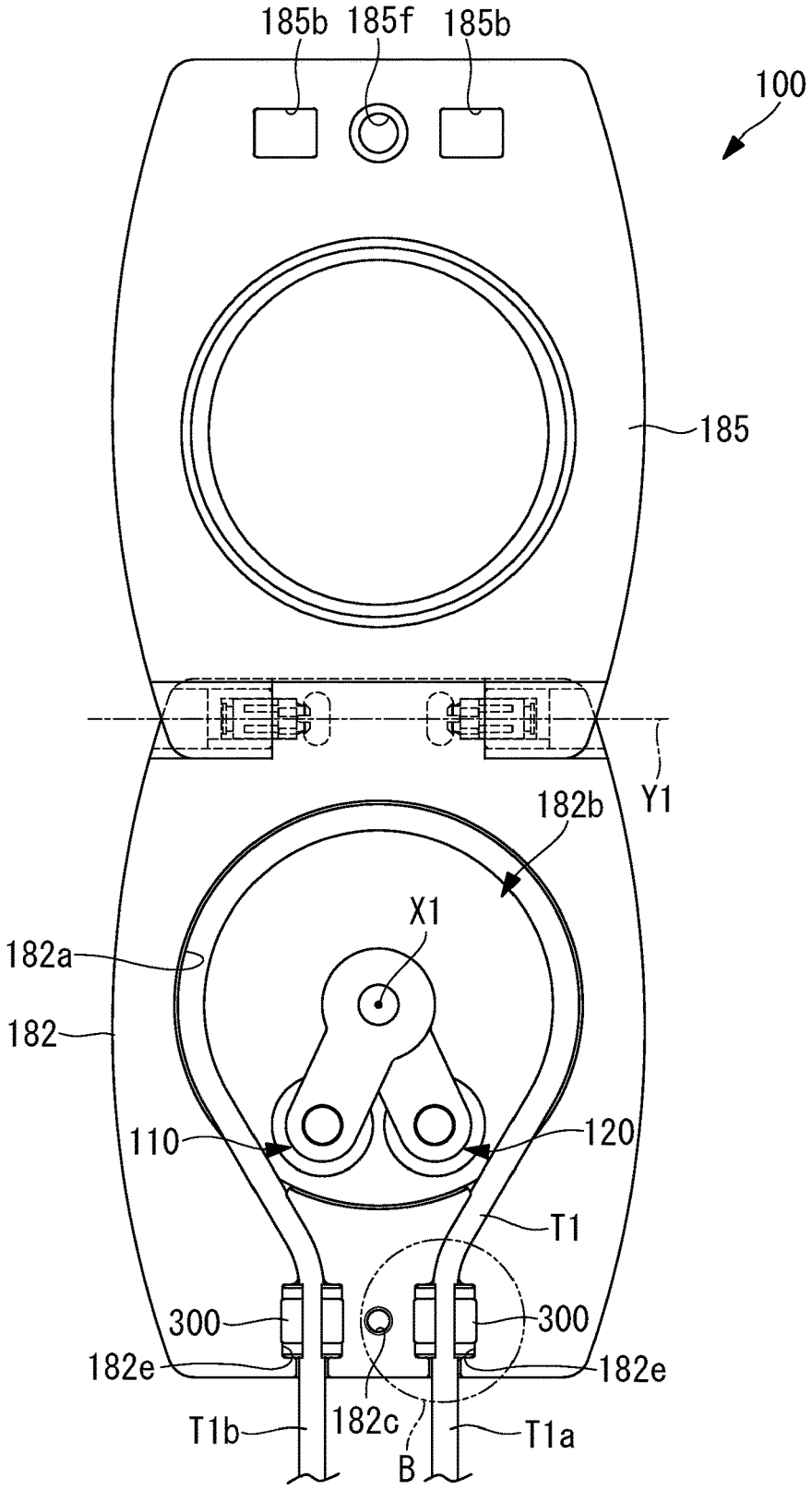
FIG. 2 is a plan view illustrating an embodiment of a first tube pump with a lid portion in an opened state.

Hereinafter, a tube pump system 1 according to an embodiment of the present disclosure will be described with reference to the drawings. FIG. 1 is a plan view illustrating an embodiment of the tube pump system 1. FIG. 2 is a plan view illustrating an embodiment of a first tube pump 100 with a lid portion 185 in an opened state.

The tube pump system (peristaltic pump system) 1 according to the present embodiment includes a first tube pump 100 and a second tube pump 200. A first tube T1 included in the first tube pump 100 and a second tube T2 included in the second tube pump 200 allow different types of liquids to be distributed therethrough.

The first tube pump 100 according to the present embodiment illustrated in FIG. 1 is a device that causes the liquid in the first tube T1, which has flowed into the first tube T1 from a flow-in side T1*a*, to be ejected on a flow-out side T1*b* by causing a roller portion (first roller portion) 110 and a roller portion (first roller portion) 120 to rotate in the same direction (the direction illustrated with the arrows in FIG. 1) about an axial line (first rotational axis) X1.

As illustrated in the plan view in FIG. 1, the first tube pump 100 includes an accommodating portion (first accommodating portion) 182 with an inner circumferential surface (first inner circumferential surface) 182*a* on which the first tube T1 with flexibility is disposed in an arc shape around the axial line X1. The inner circumferential surface 182*a* is a surface, which is formed into an arc shape around the axial line X1, on which the first tube T1 is disposed. The accommodating portion 182 includes a recessed portion 182*b* that is opened toward one end side along the axial line X1 and accommodates the roller portion 110 and the roller portion 120.

As illustrated in FIG. 1, the first tube pump 100 includes the roller portion 110 and the roller portion 120 that are accommodated in the accommodating portion 182 and rotate about the axial line X1 in a state in which the first tube T1 is blocked. The roller portion 110 and the roller portion 120 transport the liquid from the flow-in side T1*a* toward the flow-out side T1*b* by rotating about the axial line X1 along a counterclockwise rotational direction (the direction illustrated with the arrows in FIG. 1) while being in contact with the first tube T1.

The first tube pump 100 includes a first drive motor (not illustrated) that generates a drive force for causing the roller portion 110 to rotate about the axial line X1, a second drive motor (not illustrated) that generates a drive force for causing the roller portion 120 to rotate about the axial line X1, and a first control unit (not illustrated) that controls the first drive motor and the second drive motor.

An angular speed (first angular speed) of the roller portion 110 and the roller portion 120 is adjusted such that pulsation (a change in flow amount of the liquid flowing out from the flow-out side T1*b*) decreases when the liquid flowing thereinto from the flow-in side T1*a* flows out to the flow-out side T1*b*. Specifically, an angle θ1 (see FIG. 1) formed by the roller portion 110 and the roller portion 120 is adjusted such that a pressure difference of the liquid on the upstream side and the downstream side of each roller caused when the roller portion 110 and the roller portion 120 release the state in which the first tube T1 is blocked decreases.

The second tube pump 200 according to the present embodiment illustrated in FIG. 1 is a device that causes the liquid in the second tube T2, which has flowed into the second tube T2 from the flow-in side T2*a*, to be ejected on the flow-out side T2*b* by causing a roller portion (second roller portion) 210 and a roller portion (second roller portion) 220 to rotate in the same direction (the direction illustrated with the arrows in FIG. 1) about an axial line (second rotational axis) X2.

As illustrated in the plan view in FIG. 1, the second tube pump 200 includes an accommodating portion (second accommodating portion) 282 with an inner circumferential surface (second inner circumferential surface) 282*a* on which the second tube T2 with flexibility is disposed in an arc shape around the axial line X2. The inner circumferential surface 282*a* is a surface, which is formed into an arc shape around the axial line X2, on which the second tube T2 is disposed. The accommodating portion 282 includes a recessed portion 282*b* that is opened toward one end side along the axial line X2 and accommodates the roller portion 210 and the roller portion 220.

As illustrated in FIG. 1, the second tube pump 200 includes the roller portion 210 and the roller portion 220 that are accommodated in the accommodating portion 282 and rotate about the axial line X2 in a state in which the second tube T2 is blocked. The roller portion 210 and the roller portion 220 transport the liquid from the flow-in side T2*a* toward the flow-out side T2*b* by rotating about the axial line X2 along the counterclockwise rotational direction (the direction illustrated with the arrows in FIG. 1) while being in contact with the second tube T2.

The second tube pump 200 includes a third drive motor (not illustrated) that generates a drive force for causing the roller portion 210 to rotate about the axial line X2, a fourth drive motor (not illustrated) that generates a drive force for causing the roller portion 220 to rotate about the axial line X1, and a second control unit (not illustrated) that controls the third drive motor and the fourth drive motor.

An angular speed (second angular speed) of the roller portion 210 and the roller portion 220 is adjusted such that pulsation (a change in flow amount of the liquid flowing out from the flow-out side T2*b*) decreases when the liquid flowing thereinto from the flow-in side T2*a* flows out to the flow-out side T2*b*. Specifically, an angle θ2 (see FIG. 1) formed by the roller portion 210 and the roller portion 220 is adjusted such that a pressure difference of the liquid on the upstream side and the downstream side of each roller caused when the roller portion 210 and the roller portion 220 release the state in which the second tube T2 is blocked decreases.

The angular speed (first angular speed) of the roller portion 110 and the roller portion 120 of the first tube pump 100 is controlled by the first control unit such that the pulsation decreases in accordance with the inner diameter and the outer diameter of the first tube T1. Similarly, the angular speed (second angular speed) of the roller portion 210 and the roller portion 220 of the second tube pump 200 is controlled by the second control unit such that the pulsation decreases in accordance with the inner diameter and the outer diameter of the second tube T2.

Then, at least either the inner diameters or the outer diameters of the first tube T1 to be attached to the first tube pump 100 and of the second tube T2 to be attached to the second tube pump 200 are different. Therefore, the angular speed (first angular speed) of the roller portion 110 and the roller portion 120 of the first tube pump 100 and the angular speed (second angular speed) of the roller portion 210 and the roller portion 220 of the second tube pump 200 are different from each other.

In addition, if the second tube T2 is erroneously attached to the first tube pump 100, then the pulsation of the liquid flowing out from the flow-out side T1*b* increases due to the angular speed (first angular speed) of the roller portion 110 and the roller portion 120 adjusted in accordance with the inner diameter and the outer diameter of the first tube T1.

Similarly, if the first tube T1 is erroneously attached to the second tube pump 200, the pulsation of the liquid flowing out from the flow-out side T1*b* increases due to the angular speed (second angular speed) of the roller portion 210 and the roller portion 220 adjusted in accordance with the inner diameter and the outer diameter of the second tube T2. Thus, the second tube T2 is prevented from being erroneously attached to the first tube pump 100, and the first tube T1 is prevented from being erroneously attached to the second tube pump 200 in order to cause the liquid to be transported in a state in which the pulsation has appropriately been reduced in the present embodiment.

Figure 3:
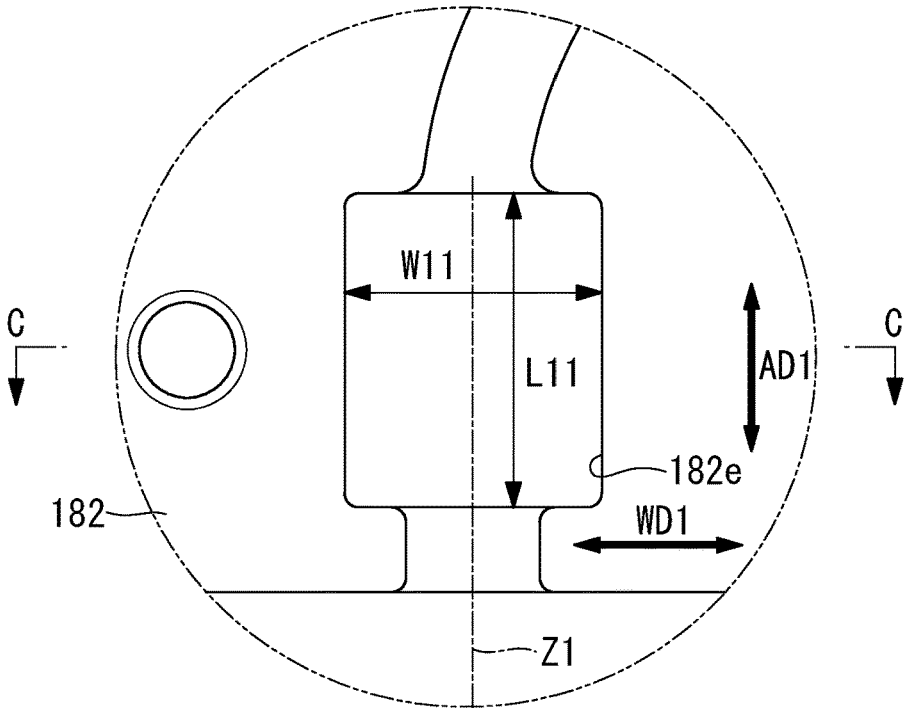
FIG. 3 is a partially enlarged view of the portion B illustrated in FIG. 2 and is a diagram illustrating a state in which a first tube and first tube holding members have not been attached to an accommodating portion.
Figure 4:
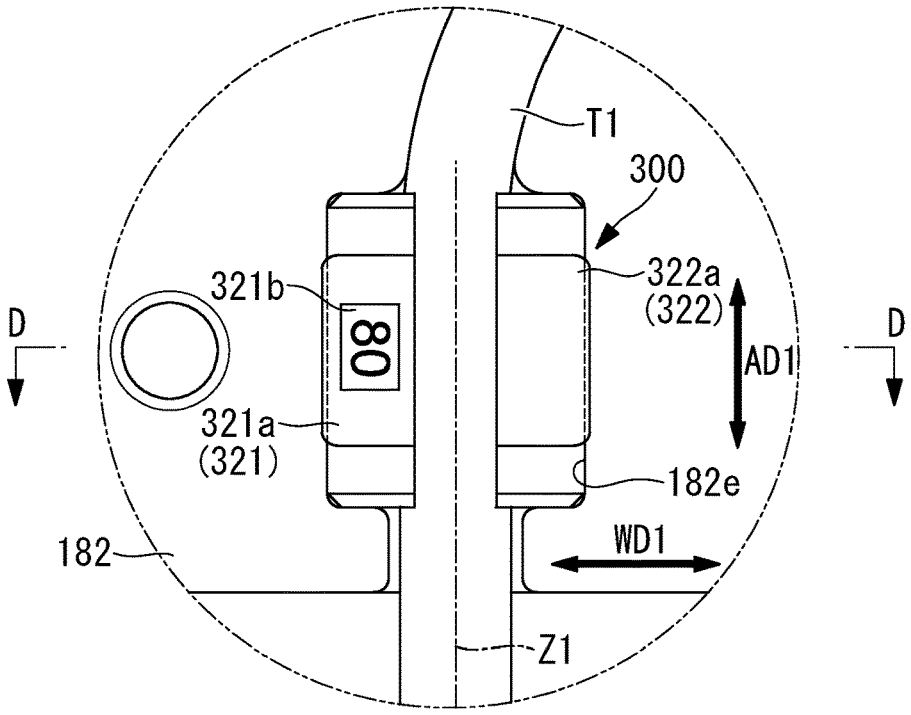
FIG. 4 is a partially enlarged view of the portion B illustrated in FIG. 2 and is a diagram illustrating a state in which the first tube and the first tube holding members have been attached to the accommodating portion.

Next, first tube holding members 300 included in the first tube pump 100 according to the present embodiment will be described with reference to the drawings. FIG. 2 is a plan view illustrating an embodiment of the first tube pump 100 with the lid portion 185 in an opened state. FIG. 3 is a partially enlarged view of the portion B illustrated in FIG. 2 and is a diagram illustrating a state in which the first tube T1 and the first tube holding members 300 have not been attached to the accommodating portion 182. FIG. 4 is a partially enlarged view of the portion B illustrated in FIG. 2 and is a diagram illustrating a state in which the first tube T1 and the first tube holding members 300 have been attached to the accommodating portion 182.

As illustrated in FIG. 2, the first tube pump 100 according to the present embodiment includes the first tube holding members 300 and the lid portion 185 that can be switched between opened and closed states by swinging around an axial line Y1. The first tube pump 100 illustrated in FIG. 2 is illustrated in a retreating state in which the rotational angle of the roller portion 110 and the roller portion 120 around the axial line X1 is fixed and both the roller portion 110 and the roller portion 120 are not in contact with the first tube T1.

A through-hole 185*f* having an inner circumferential surface with a female screw formed thereon is formed in the lid portion 185. A male screw to which a knob portion (not illustrated) that the operator can rotate is attached is fastened to the female screw of the through-hole 185*f*. The through-hole 185*f* is disposed at a location that is coaxial with a fastening hole 182*c* formed in the accommodating portion 182 in a case in which the lid portion 185 is brought into a closed state.

A female screw is formed on the inner circumferential surface of the fastening hole 182*c*. The operator can cause the male screw attached to the knob portion to be engaged with the female screw of the fastening hole 182*c* by causing the knob portion to rotate in the case in which the lid portion 185 is brought into the closed state. If the male screw attached to the knob portion is engaged with the female screw of the fastening hole 182*c*, then the lid portion 185 is fixed such that the closed state is maintained. The first tube holding members 300 are thus prevented from being detached from the accommodating portion 182 in a case in which the lid portion 185 is fixed in the closed state.

A pair of through-holes 185*b* that accommodate the pair of first tube holding members 300 in the closed state are formed in the lid portion 185. It is thus possible for the operator to recognize identification information for identifying the first tube T1 displayed at a display portion 321*b*, which will be described later, in the closed state.

Figure 6:
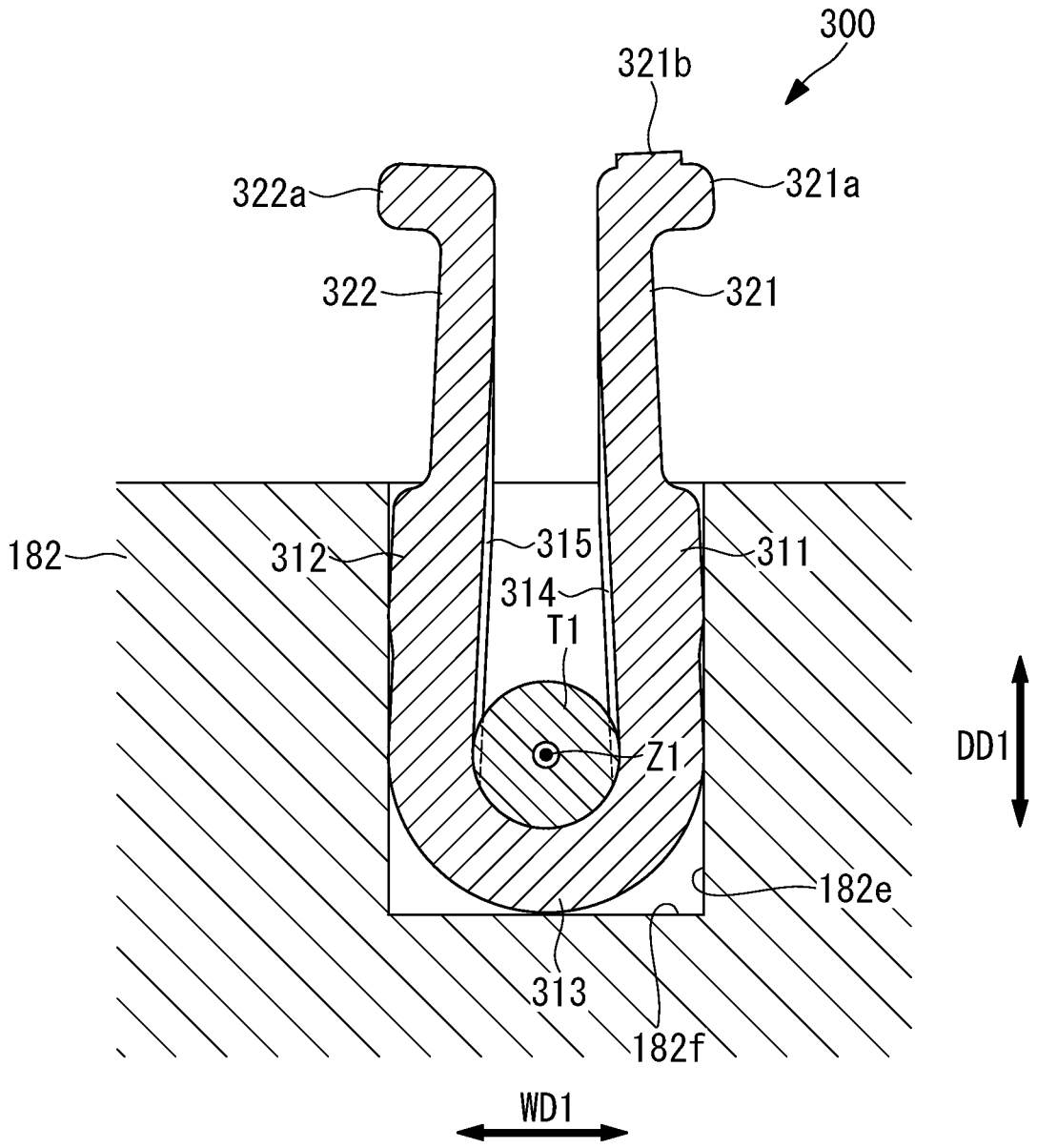
FIG. 6 is a sectional view of the arrows D-D in FIG. 4.

The first tube holding members 300 are members that are inserted into a first insertion groove 182*e* formed in the accommodating portion 182 and hold the first tube T1 in the first insertion groove 182*e* along a first axial direction AD1. As illustrated in FIGS. 4 and 6, the first insertion groove 182*e* is a groove that is formed in the accommodating portion 182 and extends along the first axial direction AD1 that is a direction in which an axial line Z1 extends.

The first insertion groove 182*e* has a first width W11 in a first width direction WD1 that perpendicularly intersects the first axial direction AD1. As illustrated in FIG. 3, the first width W11 of the first insertion groove 182*e* is the same width at each location in the first axial direction AD1. As illustrated in FIG. 4, the first width W11 of the first insertion groove 182*e* is the same width at each location in a first depth direction DD1 in which the first tube holding members 300 are inserted into the first insertion groove 182*e*.

The first insertion groove 182*e* has a first length L11 in the first axial direction AD1 as illustrated in FIG. 3. The first length L11 of the first insertion groove 182*e* is the same length at each location in the first width direction WD1 of the first tube holding members 300.

Figure 5:
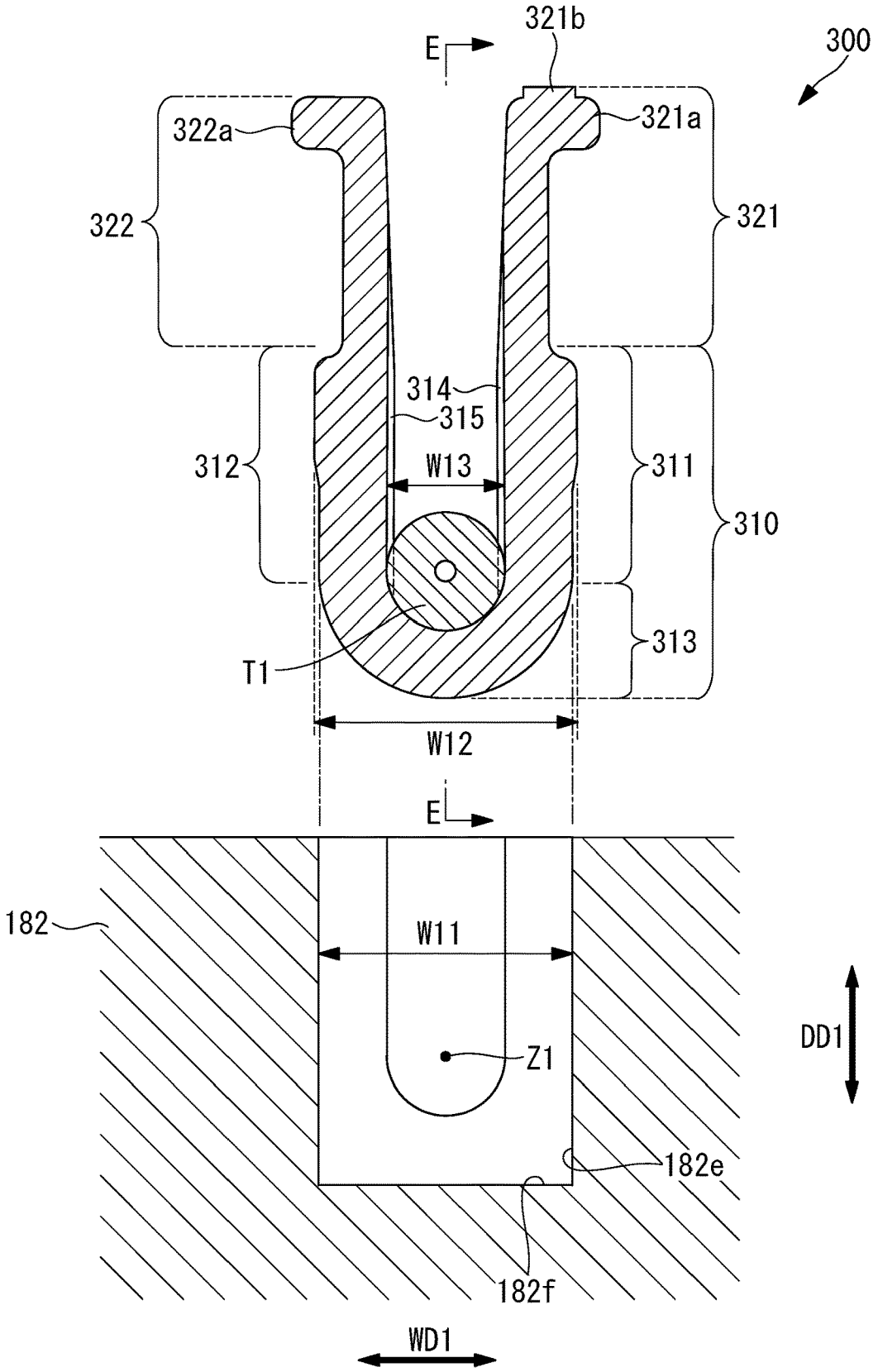
FIG. 5 is a sectional view of the arrows C-C in FIG. 3.
Figure 7:
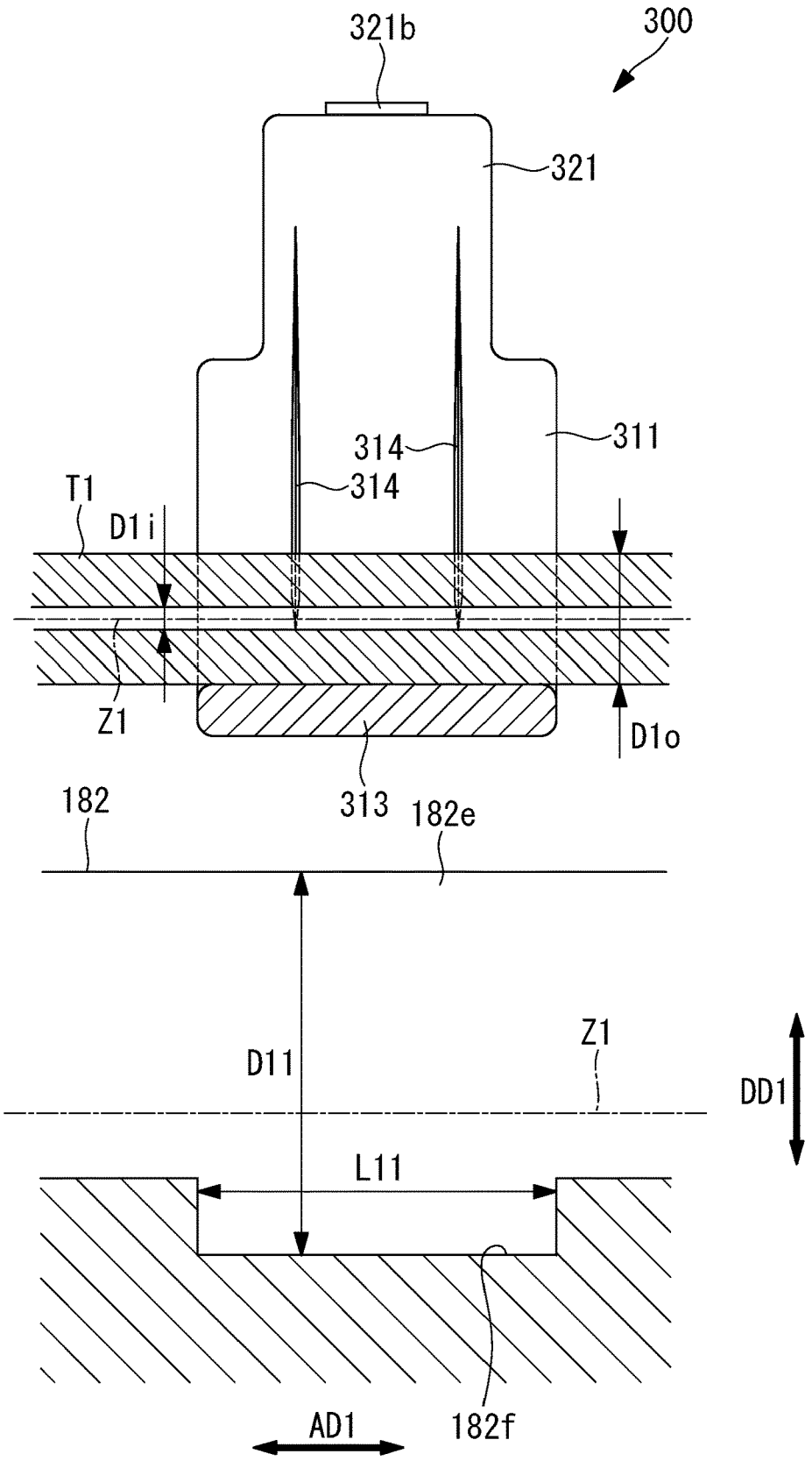
FIG. 7 is a sectional view of the arrows E-E in FIG. 5.

FIG. 5 is a sectional view of the arrows C-C in FIG. 3. FIG. 6 is a sectional view of the arrows D-D in FIG. 4. FIG. 7 is a sectional view of the arrows E-E in FIG. 5.

As illustrated in FIGS. 5 and 6, each first tube holding member 300 includes an insertion portion 310, an arm portion 321, and an arm portion 322. The insertion portion 310, the arm portion 321, and the arm portion 322 are integrally molded using an elastically deformable resin material with flexibility (polycarbonate, for example).

The insertion portion 310 is inserted into the first insertion groove 182*e* in a state in which the first tube T1 is disposed along the first axial direction AD1. The arm portion 321 and the arm portion 322 are portions that extend along the first axial direction AD1 and project from the first insertion groove 182*e* in a state in which the insertion portion 310 is inserted up to a bottom portion 182*f* of the first insertion groove 182*e*.

The insertion portion 310 includes a wall portion 311, a wall portion 312, and a coupling portion 313. The wall portion 311 is a member that extends along the first axial direction AD1 and is coupled to the arm portion 321. The wall portion 312 is a member that extends along the first axial direction AD1 and is coupled to the arm portion 322. The wall portion 311 and the wall portion 312 are disposed at an interval in the first width direction WD1 to hold the first tube T1 therebetween in a pinched state.

The coupling portion 313 is a member that extends along the first axial direction AD1 and couples the wall portion 311 and the wall portion 312. As illustrated in FIG. 5, the coupling portion 313 is disposed to face the bottom portion 182*f* of the first insertion groove 182*e* in a state in which the insertion portion 310 is inserted into the first insertion groove 182*e*. Since the coupling portion 313 is formed using a resin material, the coupling portion 313 is a member that is elastically deformable to contract along the first width direction WD1 by the operator pinching the arm portion 321 and the arm portion 322 with finger tips and narrowing the interval therebetween in the first width direction WD1.

As illustrated in FIG. 5, the wall portion 311 and the wall portion 312 have a second width W12 which is longer than the first width W11 in the first width direction WD1 in a state in which the insertion portion 310 is not inserted into the first insertion groove 182*e*. As illustrated in FIG. 6, the wall portion 311 and the wall portion 312 are disposed to be in contact with the first insertion groove 182*e* such that the wall portion 311 and the wall portion 312 have the first width W11 in the first width direction WD1 in a state in which the insertion portion 310 is inserted into the first insertion groove 182*e*.

As illustrated in FIGS. 5 and 6, projecting portions 314 that project toward the first tube T1 and extend along the first depth direction DD1 that perpendicularly intersects the first axial direction AD1 are formed in a surface of the wall portion 311 that comes into contact with the first tube T1. Projecting portions 315 that project toward the first tube T1 and extend in a direction that perpendicularly intersects the first axial direction AD1 are formed in a surface of the wall portion 312 that comes into contact with the first tube T1.

As illustrated in FIG. 7, the projecting portions 314 are formed in the wall portion 311 to extend along the first depth direction DD1 that perpendicularly intersects the first axial direction AD1 and are disposed at two locations with an interval therebetween along the first axial direction AD1. Although not illustrated, the projecting portions 315 are also formed in the wall portion 312 to extend along the first depth direction DD1 that perpendicularly intersects the first axial direction AD1 and are disposed at two locations with an interval therebetween along the first axial direction AD1.

As illustrated in FIG. 7, the projecting portions 314 have a length that is equal to or greater than an outer diameter D1*o* of the first tube T1 from the arm portion 321 toward the lower side of the wall portion 311. Although not illustrated, the projecting portions 315 also have a length that is equal to or greater than the outer diameter D1*o* of the first tube T1 from the arm portion 322 toward the lower side of the wall portion 312.

Therefore, the projecting portions 314 and the projecting portions 315 are caused to abut on the outer circumferential surface of the first tube T1 when the operator inserts the first tube T1 between the wall portion 311 and the wall portion 312 from the upper side of the arm portion 321 and the arm portion 322. The first tube T1 is thus prevented from moving along the first axial direction AD1 relative to the first tube holding member 300.

Also, the projecting portions 314 and the projecting portions 315 are caused to strongly abut on the outer circumferential surface of the first tube T1 even in a state in which the first tube T1 is attached to the first tube holding member 300. It is thus possible to hold the first tube T1 held in a state in which the first tube T1 is pinched between the wall portion 311 and the wall portion 312 such that the first tube T1 does not move along the first axial direction AD1.

As illustrated in FIG. 7, the first insertion groove 182*e* has the first depth D11 along the first depth direction DD1. The first depth D11 is the same length at each location in the first axial direction AD1. In other words, the first insertion groove 182*e* has the same shape in the first depth direction DD1 at each location in the first axial direction AD1.

The coupling portion 313 of each first tube holding member 300 has the same shape at each location in the first axial direction AD1 as the shape of the bottom portion 182*f* of the first insertion groove 182*e*. Since the first tube holding member 300 has the shape corresponding to the first insertion groove 182*e* in this manner, the first tube holding member 300 can be inserted into the first insertion groove 182*e*.

The arm portion 321 and the arm portion 322 are portions that the operator pinches with finger tips when the operator inserts the first tube holding member 300 into the first insertion groove 182*e*. A distal end portion 321*a* of the arm portion 321 is formed into a shape projecting outward (to the side away from the first tube T1) in the first width direction WD1. A distal end portion 322*a* of the arm portion 322 is formed into a shape projecting outward in the first width direction WD1.

The operator inserts the first tube T1 up to a location at which the first tube T1 comes into contact with the inner circumferential surface of the coupling portion 313, then pinches the distal end portion 321*a* and the distal end portion 322*a* with two fingers, and shortens the length between the wall portion 311 and the wall portion 312 in the first width direction WD1 as compared with the first width W11 of the first insertion groove 182*e*. The operator inserts the insertion portion 310 up to the bottom portion 182*f* of the first insertion groove 182*e* and then releases the state in which the distal end portion 321*a* and the distal end portion 322*a* are pinched with the finger tips.

If the operator releases the state in which the distal end portion 321*a* and the distal end portion 322*a* are pinched with the finger tips, then a part of elastic deformation of the coupling portion 313 is released, the length between the wall portion 311 and the wall portion 312 in the first width direction WD1 is widened up to the first width W11 of the first insertion groove 182*e*, and each of the wall portion 311 and the wall portion 312 comes into contact with the first insertion groove 182*e*. Since a part of the elastic deformation of the coupling portion 313 is held without being released, the insertion portion 310 is held in the first insertion groove 182*e* with an elastic force of the coupling portion 313.

As illustrated in FIG. 4, the display portion 321*b* that displays first identification information for identifying the first tube T1 held by the wall portion 311 and the wall portion 312 is provided at the distal end portion 321*a* of the arm portion 321. At the display portion 321*b* illustrated in FIG. 4, identification information "80" indicating that the inner diameter D1*i* (see FIG. 7) of the first tube T1 is 0.80 mm is displayed.

The display portion 321*b* displays the identification information with a paint or the like with a color different from that of the other part, for example. Also, the display portion 321*b* may be molded into a shape indicating the identification information. Moreover, the display portion 321*b* may be an attached sticker or the like on which the identification information has been printed. Also, the identification information displayed at the display portion 321*b* may be other information that is different from the information indicating the inner diameter D1*i* of the first tube T1.

For example, the identification information may be a character code associated with the inner diameter D1*i* of the first tube T1, information indicating the outer diameter D1*o* of the first tube T1, a character code associated with the outer diameter D1*o* of the first tube T1, information indicating the material of the first tube T1, information for identifying one of the pair of first tube holding members 300 from the other, or information obtained by combining such information. Also, the resin material forming the first tube holding members 300 may be colored with a desired color corresponding to the first tube T1 instead of the display portion 321*b* being provided.

Figure 8:
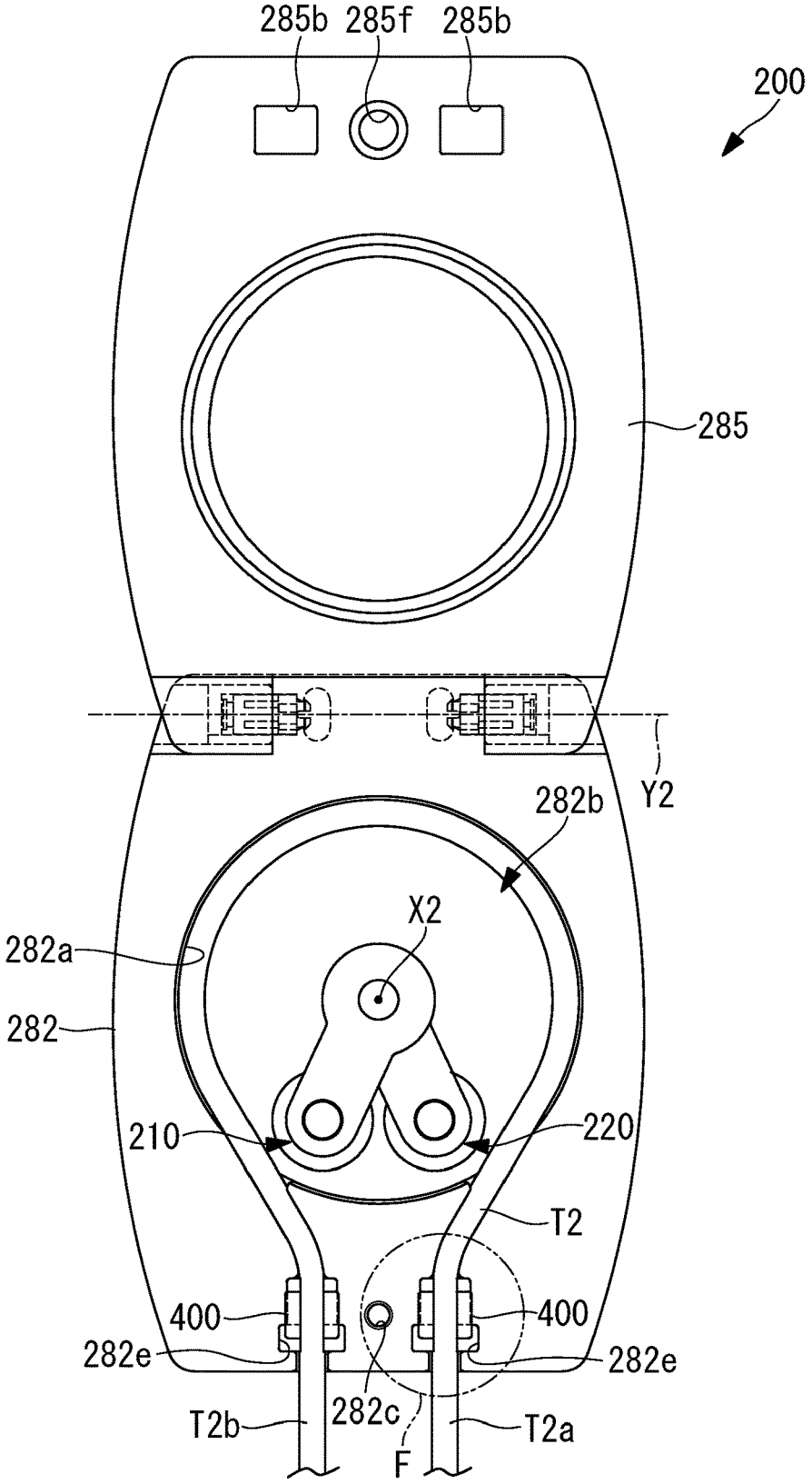
FIG. 8 is a plan view illustrating an embodiment of a second tube pump with a lid portion in an opened state.
Figure 9:
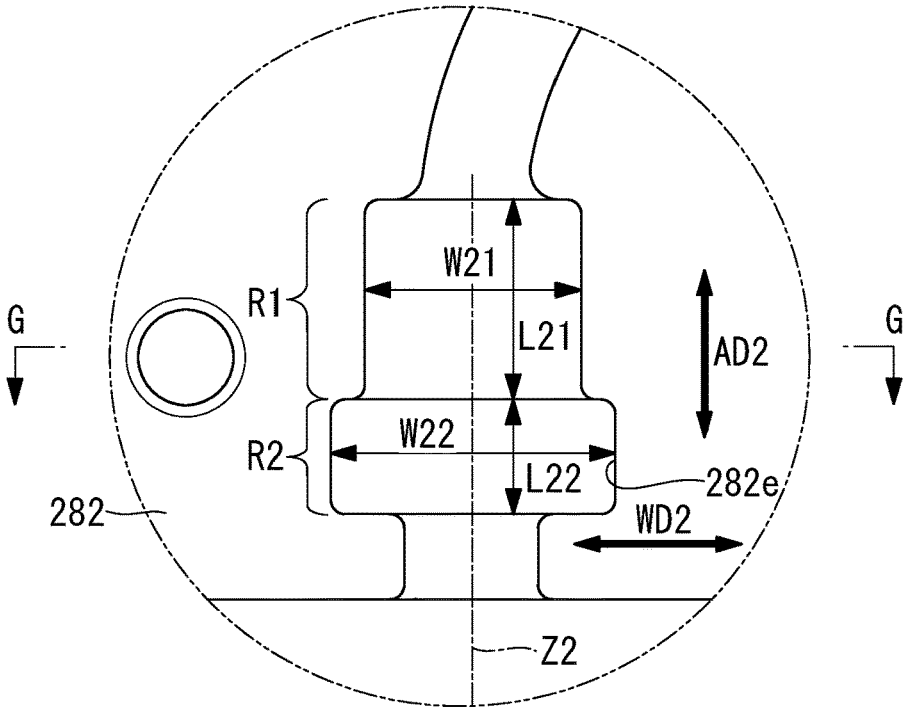
FIG. 9 is a partially enlarged view of the portion F illustrated in FIG. 8 and is a diagram illustrating a state in which a second tube and second tube holding members have not been attached to an accommodating portion.
Figure 10:
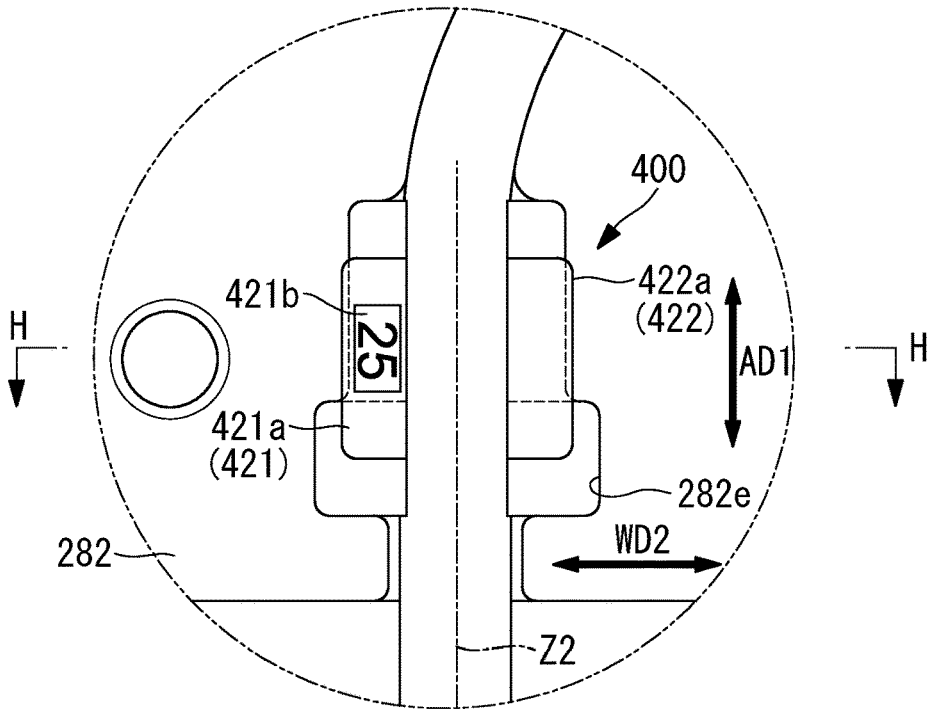
FIG. 10 is a partially enlarged view of the portion F illustrated in FIG. 8 and is a diagram illustrating a state in which the second tube and the second tube holding members have been attached to the accommodating portion.

Next, second tube holding members 400 included in the second tube pump 200 according to the present embodiment will be described with reference to the drawings. FIG. 8 is a plan view illustrating an embodiment of the second tube pump 200 with a lid portion 285 in an opened state. FIG. 9 is a partially enlarged view of the portion F illustrated in FIG. 8 and is a diagram illustrating a state in which the second tube T2 and the second tube holding members 400 have not been attached to the accommodating portion 282. FIG. 10 is a partially enlarged view of the portion F illustrated in FIG. 8 and is a diagram illustrating a state in which the second tube T2 and the second tube holding members 400 have been attached to the accommodating portion 282.

As illustrated in FIG. 8, the second tube pump 200 according to the present embodiment includes the second tube holding members 400 and the lid portion 285 that can be switched between opened and closed state by swinging around an axial line Y2. The second tube pump 200 illustrated in FIG. 8 is illustrated in a retreating state in which the rotational angle of the roller portion 210 and the roller portion 220 around the axial line X2 is fixed and both the roller portion 210 and the roller portion 220 are not in contact with the second tube T2.

A through-hole 285*f* having an inner circumferential surface with a female screw formed thereon is formed in the lid portion 285. A male screw attached to a knob portion (not illustrated) that the operator can rotate is fastened to the female screw of the through-hole 285*f*. The through-hole 285*f* is disposed at a location that is coaxial with a fastening hole 282*c* formed in the accommodating portion 282 in a case in which the lid portion 285 is brought into a closed state.

A female screw is formed on the inner circumferential surface of the fastening hole 282*c*. The operator can cause the male screw attached to the knob portion to be engaged with the female screw of the fastening hole 282*c* by causing the knob portion to rotate in the case in which the lid portion 285 is brought into the closed state. If the male screw attached to the knob portion is engaged with the female screw of the fastening hole 282*c*, then the lid portion 285 is fixed such that the closed state is maintained. The second tube holding members 400 are thus prevented from being detached from the accommodating portion 282 in the case in which the lid portion 285 is fixed in the closed state.

A pair of through-holes 285*b* that accommodate the pair of second tube holding members 400 in the closed state are formed in the lid portion 285. It is thus possible for the operator to recognize identification information for identifying the second tube T2 displayed at a display portion 421*b*, which will be described later, in the closed state.

Figure 11:
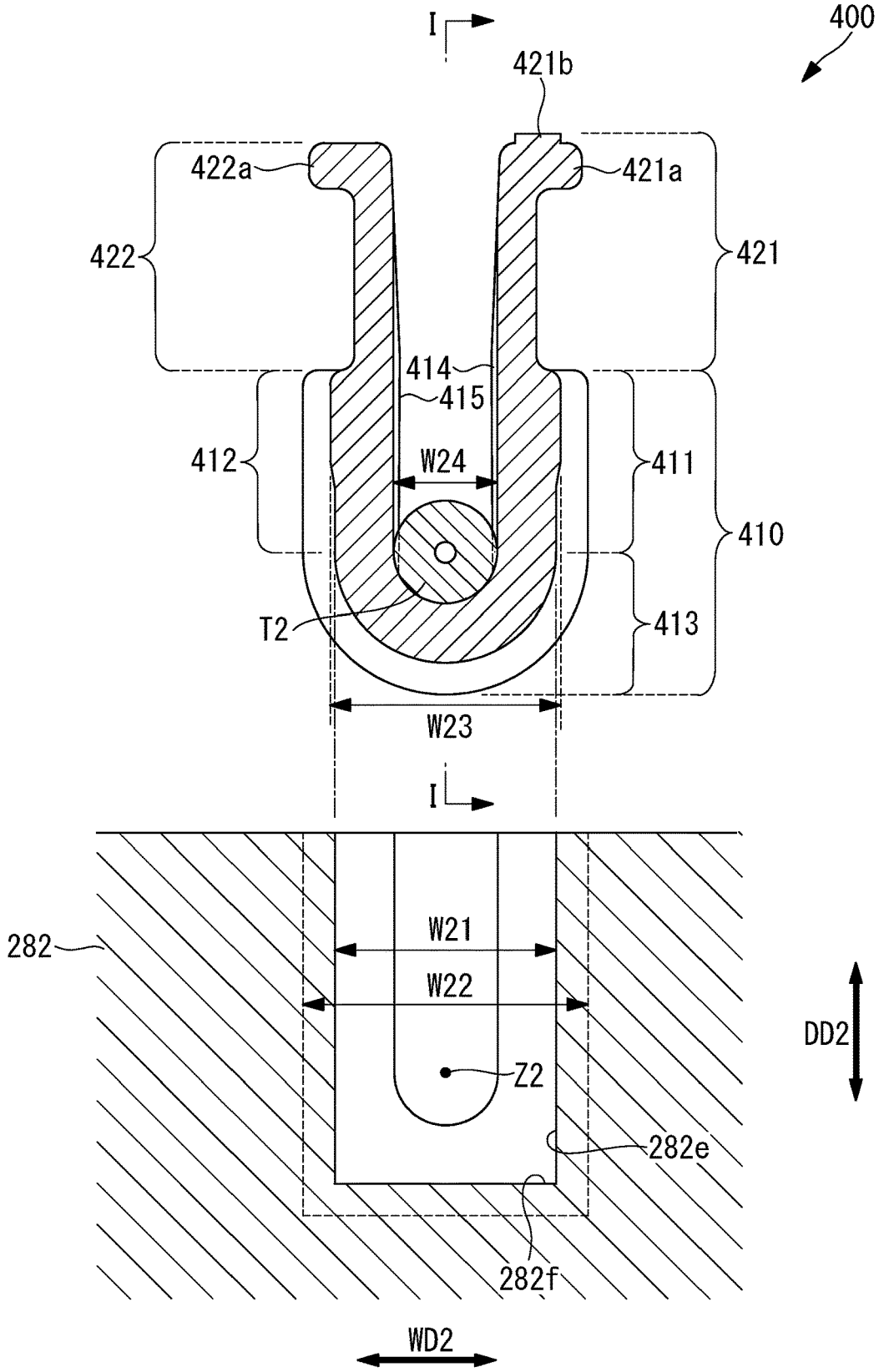
FIG. 11 is a sectional view of the arrows G-G in FIG. 9.

The second tube holding members 400 are members that are inserted into a second insertion groove 282*e* formed in the accommodating portion 282 and hold the second tube T2 in the second insertion groove 282*e* along a second axial direction AD2. As illustrated in FIGS. 9 and 11, the second insertion groove 282*e* is a groove that is formed in the accommodating portion 282 and extends along the second axial direction AD2 that is a direction in which the axial line Z2 extends.

As illustrated in FIG. 9, the second insertion groove 282*e* includes a first region R1 with a first width W21 in a second width direction WD2 that perpendicularly intersects the second axial direction AD2 and a second region R2 with a second width W22. As illustrated in FIG. 9, the first width W21 of the first region R1 of the second insertion groove 282*e* is the same width at each location in the second axial direction AD2. The second width W22 of the second region R2 of the second insertion groove 282*e* is the same width at each location in the second axial direction AD2.

As illustrated in FIG. 11, the first width W21 of the first region R1 of the second insertion groove 282*e* is the same width at each location in a second depth direction DD2 in which the second tube holding members 400 are inserted into the second insertion groove 282*e*. Also, the second width W22 of the second region R2 of the second insertion groove 282*e* is the same width at each location in the second depth direction DD2.

As illustrated in FIG. 9, the first region R1 of the second insertion groove 282*e* has a first length L21 in the second axial direction AD2. The first length L21 is the same length at each location in the second width direction WD2 of the second tube holding members 400. The second region R2 of the second insertion groove 282*e* has a second length L22 in the second axial direction AD2. The second length L22 is the same length at each location in the second width direction WD2 of the second tube holding members 400.

Figure 12:
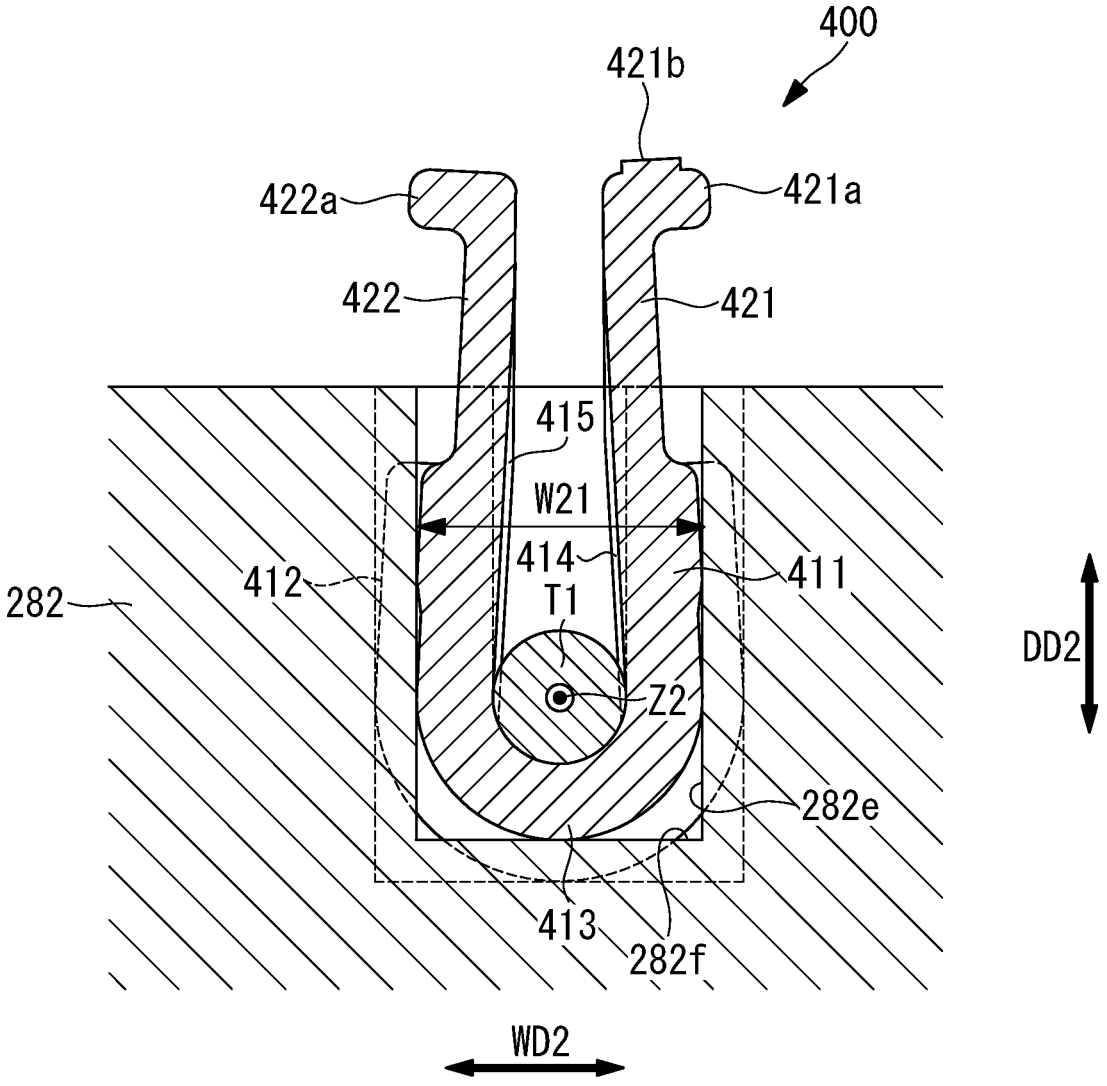
FIG. 12 is a sectional view of the arrows H-H in FIG. 10.
Figure 13:
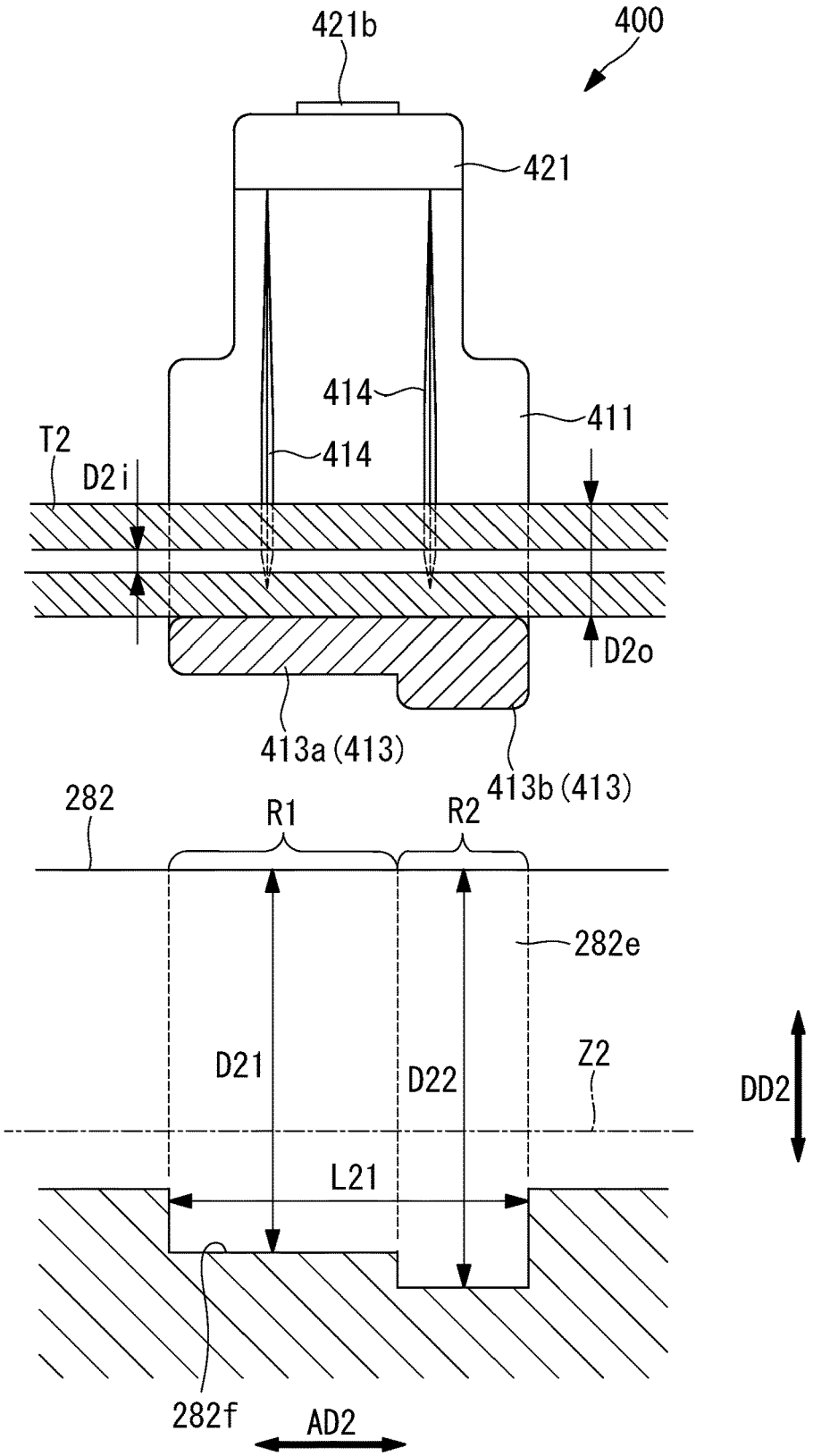
FIG. 13 is a sectional view of the arrows I-I in FIG. 11.

FIG. 11 is a sectional view of the arrows G-G in FIG. 9. FIG. 12 is a sectional view of the arrows H-H in FIG. 10. FIG. 13 is a sectional view of the arrows I-I in FIG. 11. As illustrated in FIGS. 11 and 12, each second tube holding member 400 includes an insertion portion 410, an arm portion 421, and an arm portion 422. The insertion portion 410, the arm portion 421, and the arm portion 422 are integrally molded using an elastically deformable resin material with flexibility (polycarbonate, for example).

The insertion portion 410 is inserted into the second insertion groove 282*e* in a state in which the second tube T2 is disposed along the second axial direction AD2. The arm portion 421 and the arm portion 422 are portions that extend along the second axial direction AD2 and project from the second insertion groove 282*e* in a state in which the insertion portion 410 is inserted up to a bottom portion 282*f* of the second insertion groove 282*e*.

The insertion portion 410 includes a wall portion 411, a wall portion 412, and a coupling portion 413. The wall portion 411 is a member that extends along the second axial direction AD2 and is coupled to the arm portion 421. The wall portion 412 is a member that extends along the second axial direction AD2 and is coupled to the arm portion 422. The wall portion 411 and the wall portion 412 are disposed at an interval in the second width direction WD2 to hold the second tube T2 therebetween in a pinched state.

The coupling portion 413 is a member that extends along the second axial direction AD2 and couples the wall portion 411 and the wall portion 412. As illustrated in FIG. 12, the coupling portion 413 is disposed to face the bottom portion 282*f* of the second insertion groove 282*e* in a state in which the insertion portion 410 is inserted into the second insertion groove 282*e*. Since the coupling portion 413 is formed using the resin material, the coupling portion 413 is a member that is elastically deformable to contract along the second width direction WD2 by the operator pinching the arm portion 421 and the arm portion 422 with finger tips and narrowing the interval therebetween in the second width direction WD2.

As illustrated in FIG. 11, the wall portion 411 and the wall portion 412 have a third width W23 that is longer than the first width W21 in the second width direction WD2 in a state in which the insertion portion 410 is not inserted into the second insertion groove 282*e*. As illustrated in FIG. 12, the wall portion 411 and the wall portion 412 are disposed to be in contact with the second insertion groove 282*e* such that the wall portion 411 and the wall portion 412 have the second width W22 in the second width direction WD2 in a state in which the insertion portion 410 is inserted into the second insertion groove 282*e*.

As illustrated in FIGS. 11 and 12, projecting portions 414 that project toward the second tube T2 and extend along the second depth direction DD2 that perpendicularly intersects the second axial direction AD2 are formed in a surface of the wall portion 411 that comes into contact with the second tube T2. Projecting portions 415 that project toward the second tube T2 and extend in a direction that perpendicularly intersects the second axial direction AD2 are formed in a surface of the wall portion 412 that comes into contact with the second tube T2.

As illustrated in FIG. 13, the projecting portions 414 are formed in the wall portion 411 to extend along the second depth direction DD2 that perpendicularly intersects the second axial direction AD2 and are disposed at two locations with an interval therebetween along the second axial direction AD2. Although not illustrated, the projecting portions 415 are also formed in the wall portion 412 to extend along the second depth direction DD2 that perpendicularly intersects the second axial direction AD2 and are disposed at two locations with an interval therebetween along the second axial direction AD2.

As illustrated in FIG. 13, the projecting portions 414 have a length that is equal to or greater than an outer diameter D2*o* of the second tube T2 from the arm portion 421 toward the lower side of the wall portion 411. Although not illustrated, the projecting portions 415 also have a length that is equal to or greater than the outer diameter D2*o* of the second tube T2 from the arm portion 422 toward the lower side of the wall portion 412.

Therefore, the projecting portions 414 and the projecting portions 415 are caused to abut on the outer circumferential surface of the second tube T2 when the operator inserts the second tube T2 between the wall portion 411 and the wall portion 412 from the upper side of the arm portion 421 and the arm portion 422. The second tube T2 is thus prevented from moving along the second axial direction AD2 relative to the second tube holding member 400.

Also, the projecting portions 414 and the projecting portions 415 are caused to strongly abut on the outer circumferential surface of the second tube T2 even in a state in which the second tube T2 is attached to the second tube holding member 400. Therefore, it is possible to hold the second tube T2 held in a state in which the second tube T2 is pinched between the wall portion 411 and the wall portion 412 such that the second tube T2 does not move along the second axial direction AD2.

As illustrated in FIG. 13, the first region R1 of the second insertion groove 282*e* has a first depth D21 along the second depth direction DD2. The first depth D21 is the same length at each location in the second axial direction AD2. The second region R2 of the second insertion groove 282*e* has a second depth D22 that is longer than the first depth D21 along the second depth direction DD2. The second depth D22 is the same length at each location in the second axial direction AD2.

As illustrated in FIG. 13, the coupling portion 413 of the second tube holding member 400 includes a first region 413*a* corresponding to the first region R1 of the second insertion groove 282*e* and a second region 413*b* corresponding to the second region R2 of the second insertion groove 282*e*. The shape of the coupling portion 413 of the second tube holding member 400 at each location in the second axial direction AD2 is the same shape as that of the bottom portion 282*f* of the second insertion groove 282*e*. Since the second tube holding member 400 has the shape corresponding to the second insertion groove 282*e* in this manner, the second tube holding member 400 can be inserted into the second insertion groove 282*e*.

The arm portion 421 and the arm portion 422 are portions that the operator pinches with finger tips when the operator inserts the second tube holding member 400 into the second insertion groove 282*e*. A distal end portion 421*a* of the arm portion 421 is formed into a shape projecting outward (to the side away from the second tube T2) in the second width direction WD2. A distal end portion 422*a* of the arm portion 422 is formed into a shape projecting outward in the second width direction WD2.

The operator inserts the second tube T2 up to a location at which the second tube T2 comes into contact with the inner circumferential surface of the coupling portion 413, then pinches the distal end portion 421*a* and the distal end portion 422*a* with two fingers, and shortens the length between the wall portion 411 and the wall portion 412 in the second width direction WD2 as compared with the first width W21 of the second insertion groove 282*e*. The operator inserts the insertion portion 410 up to the bottom portion 282*f* of the second insertion groove 282*e* and then releases the state in which the distal end portion 421*a* and the distal end portion 422*a* are pinched with the finger tips.

If the operator releases the state in which the distal end portion 421*a* and the distal end portion 422*a* are pinched with the finger tips, then a part of elastic deformation of the coupling portion 413 is released, the length between the wall portion 411 and the wall portion 412 in the second width direction WD2 is widened up to the first width W21 of the second insertion groove 282*e*, and each of the wall portion 411 and the wall portion 412 comes into contact with the second insertion groove 282*e*. Since a part of the elastic deformation of the coupling portion 413 is held without being released, the insertion portion 410 is held in the second insertion groove 282*e* with an elastic force of the coupling portion 413.

As illustrated in FIG. 10, the display portion 421*b* that displays second identification information for identifying the second tube T2 held by the wall portion 411 and the wall portion 412 is provided at the distal end portion 421*a* of the arm portion 421. Identification information "25" indicating that the inner diameter D2*i* (see FIG. 13) of the second tube T2 is 0.25 mm is displayed at the display portion 421*b* illustrated in FIG. 10.

The display portion 421*b* displays the identification information with a paint or the like with a color different from that of the other part, for example. Also, the display portion 421*b* may be molded into a shape indicating the identification information. Moreover, the display portion 421*b* may be an attached sticker or the like on which the identification information has been printed. Also, the identification information displayed at the display portion 421*b* may be other information that is different from the information indicating the inner diameter D2*i* of the second tube T2.

For example, the identification information may be a character code associated with the inner diameter D2*i* of the second tube T2, information indicating the outer diameter D2*o* of the second tube T2, a character code associated with the outer diameter D2*o* of the second tube T2, information indicating the material of the second tube T2, information for identifying one of the pair of second tube holding members 400 from the other, or information obtained by combining such information. Also, the resin material forming the second tube holding members 400 may be colored with a desired color corresponding to the second tube T2 instead of the display portion 421*b* being provided.

Next, prevention of the second tube T2 from being attached to the first insertion groove 182*e* of the first tube pump 100 and prevention of the first tube T1 from being attached to the second insertion groove 282*e* of the second tube pump 200 will be described.

As described above, the shape of the first insertion groove 182*e* of the first tube pump 100 is different from the shape of the second insertion groove 282*e* of the second tube pump 200. For example, the first width W11 of the first insertion groove 182*e* is set to be wider than the first width W21 of the first region R1 of the second insertion groove 282*e* and narrower than the second width W22 of the second region R2 of the second insertion groove 282*e*.

Since the first width W21 of the second insertion groove 282*e* is narrower than the first width W11 of the first insertion groove 182*e*, the first tube holding members 300 are prevented from being inserted into the second insertion groove 282*e*. Also, since the first width W11 of the first insertion groove 182*e* is narrower than the second width W22 of the second insertion groove 282*e*, the second tube holding members 400 are prevented from being inserted into the first insertion groove 182*e*.

As illustrated in FIG. 5, the interval between the wall portion 311 and the wall portion 312 in the first width direction WD1 in the first tube holding members 300 is a first interval W13. On the other hand, the interval between the wall portion 411 and the wall portion 412 in the second width direction WD2 in the second tube holding members 400 is a second interval W24 that is shorter than the first interval W13 as illustrated in FIG. 11. The first interval W13 conforms to the outer diameter D1*o* of the first tube T1, and the second interval W24 conforms to the outer diameter D2*o* of the second tube T2. It is thus possible to prevent the second tube T2 from being erroneously held by the first tube holding members 300 and to prevent the first tube T1 from being erroneously held by the second tube holding members 400.

Actions and effects achieved by the present embodiment described above will be described.

According to the tube pump system 1 in the present embodiment, the first insertion groove 182*e* that extends along the first axial direction AD1 is formed in the accommodating portion 182 of the first tube pump 100, and the second insertion groove 282*e* that extends along the second axial direction AD2 is formed in the accommodating portion 282 of the second tube pump 200. The first tube T1 is held by the first insertion groove 182*e* along the first axial direction AD1 by the first tube holding members 300, and the second tube T2 is held in the second insertion groove 282*e* along the second axial direction AD2 by the second tube holding members 400.

According to the tube pump system 1 in the present embodiment, the shape of the first insertion groove 182*e* is different from the shape of the second insertion groove 282*e*. Also, the first tube holding members 300 have the shape corresponding to the first insertion groove 182*e*, and the second tube holding members 400 have the shape corresponding to the second insertion groove 282*e*. Therefore, the first tube holding members 300 that hold the first tube T1 are prevented from being attached to the second insertion groove 282*e* that does not correspond to the shape of the first insertion groove 182*e*.

Similarly, the second tube holding member 400 that holds the second tube T2 is prevented from being attached to the first insertion groove 182*e* that does not correspond to the shape of the second insertion groove 282*e*. Therefore, it is possible to prevent an inappropriate tube that is not adapted for the type of the liquid to be transported through a specific tube pump from being attached to the specific tube pump in the tube pump system 1 including the first tube pump 100 and the second tube pump 200.

According to the tube pump system 1 in the present embodiment, the first interval W13 between the wall portions 311 and 312 in the first width direction WD1 of the first tube holding members 300 and the second width W24 between the wall portions 411 and 412 in the second width direction WD2 of the second tube holding members 400 are different from each other. Therefore, even if the second tube T2 is inserted between the wall portions 311 and 312 of the first tube holding members 300, the second tube T2 is not held appropriately. Similarly, if the first tube T1 is inserted between the wall portions 411 and 412 of the second tube holding members 400, the first tube T1 is not held appropriately. It is thus possible to prevent the second tube T2 from being erroneously held by the first tube holding members 300 and to prevent the first tube T1 from being erroneously held by the second tube holding members 400.

According to the tube pump system 1 in the present embodiment, the groove width of the first insertion groove 182*e* and the groove width of the second insertion groove 282*e* are different from each other, the first tube holding members 300 are prevented from being attached to the second insertion groove 282*e*. Similarly, the second tube holding member 400 is prevented from being attached to the first insertion groove 182*e*.

According to the tube pump system 1 in the present embodiment, the operator can appropriately identify the first tube T1 to be attached to the first tube holding members 300 by recognizing the first identification information displayed at the display portion 321*b* of each first tube holding member 300. Similarly, the operator can appropriately identify the second tube T2 to be attached to the second tube holding member 400 by recognizing the second identification information displayed at the display portion 421*b* of each second tube holding member 400.

While example embodiments have been particularly shown and described, it will be understood by those skilled in the art that various changes in form and details may be made therein without departing from the scope of the embodiments encompassed by the appended claims.

What is claimed is:

1. A tube pump system comprising:

a first tube pump; and a second tube pump, wherein the first tube pump includes a first accommodating portion that has a first inner circumferential surface on which a first tube with flexibility is disposed in an arc shape around a first rotational axis, a first roller portion that is accommodated in the first accommodating portion and rotates about the first rotational axis in a state in which the first tube is blocked, a pair of first insertion grooves extending along a first axial direction being formed in the first accommodating portion, each of the pair of the first insertion grooves being formed in a same first shape, and a pair of first tube holding members that hold the first tube in the first insertion groove along the first axial direction, each of the pair of the first tube holding member being formed in a same second shape, the second tube pump includes a second accommodating portion that has a second inner circumferential surface on which a second tube with flexibility is disposed in an arc shape around a second rotational axis, a second roller portion that is accommodated in the second accommodating portion and rotates about the second rotational axis in a state in which the second tube is blocked, a pair of second insertion grooves extending along a second axial direction being formed in the second accommodating portion, each of the pair of the second insertion grooves being formed in a same third shape, and a pair of second tube holding members that hold the second tube in the second insertion groove along the second axial direction, each of the pair of the second tube holding member being formed in a same fourth shape, wherein the first shape is different from the third shape, the second shape corresponds to the first shape, and the fourth shape corresponds to the third shape wherein each of the pair of the first tube holding members includes a pair of first wall portions disposed at an interval in a first width direction that perpendicularly intersects the first axial direction to hold the first tube in a pinched state, each of the pair of the second tube holding members includes a pair of second wall portions disposed at an interval in a second width direction that perpendicularly intersects the second axial direction to hold the second tube in a pinched state, and a first interval between the pair of first wall portions in the first width direction and a second interval between the pair of second wall portions in the second width direction are different from each other.

2. The tube pump system according to claim 1, wherein a groove width of the pair of the first insertion grooves and a groove width of the second insertion grooves are different from each other.

3. The tube pump system according to claim 1, wherein the first shape has a same shape at each location in the first axial direction, and the second shape has different shapes at each location in the second axial direction.

4. The tube pump system according to claim 1, wherein each first insertion portion further comprises a pair of first coupling portions for coupling the pair of the first wall portion, and a pair of first arm portions that each extend along the first axial direction and project from a corresponding one of the pair of the first insertion grooves in a state in which the first insertion portion is inserted into one of the pair of the first insertion grooves, wherein each second insertion portion further comprises a pair of second coupling portions for coupling the pair of the second wall portion, and a pair of second arm portions that each extend along the second axial direction and project from a corresponding one of the pair of the second insertion grooves in a state in which the second insertion portion is inserted into one of the pair of the second insertion grooves, wherein each of the pair of the first arm portions is provided with a first display portion that displays first identification information for identifying the first tube, and each of the pair of the second arm portions is provided with a second display portion that displays second identification information for identifying the second tube.

5. The tube pump system according to claim 1, wherein a first angular speed when the first roller portion rotates about the first rotational axis and a second angular speed when the second roller portion rotates about the second rotational axis are different from each other.

* * * * *